US005671474A

United States Patent [19]

Fukano

[11] Patent Number: 5,671,474

[45] Date of Patent: Sep. 23, 1997

[54] PRESS ROLLER SUPPORTED AT OPPOSITE ENDS AND AT AN INTERIOR PORTION

[75] Inventor: Masahiko Fukano, Osaka, Japan

[73] Assignee: Mita Industrial Co., Ltd., Japan

[21] Appl. No.: 568,644

[22] Filed: Dec. 7, 1995

[30] Foreign Application Priority Data

Jan. 11, 1995 [JP] Japan ..... 7-002877

[51] Int. Cl.[6] ..... G03G 15/20

[52] U.S. Cl. ..... 399/331; 399/328

[58] Field of Search ..... 355/282, 285, 355/290, 295; 399/320, 328, 331, 339

[56] References Cited

U.S. PATENT DOCUMENTS

| | | |
|---|---|---|
| 4,428,660 | 1/1984 | Matsumoto . |
| 4,942,434 | 7/1990 | Nakai et al. . |
| 5,087,947 | 2/1992 | Torino . |
| 5,111,250 | 5/1992 | Kashiwagi . |
| 5,138,379 | 8/1992 | Kanazashi . |
| 5,283,621 | 2/1994 | Hasshizume . |
| 5,483,392 | 1/1996 | Okada . |
| 5,493,380 | 2/1996 | Saitou et al. . |

OTHER PUBLICATIONS

Patent Abstract of Japan, vol. 014, No. 169, Mar. 30, 1990, 2024687.

IBM Technical Disclosure Bulletin, vol. 24, No. 12, entitled "Quick Warm-Up Hot Roll Fuser", May 1982 pp. 6352–6353.

Research Disclosure, No. 273, Jan. 1987, p. 17, entitled "Internally-SupportedFuser Roller".

*Primary Examiner*—Sandra L. Brase

*Attorney, Agent, or Firm*—Beveridge, DeGrandi, Weilacher & Young, L.L.P.

[57] ABSTRACT

A structure for supporting a press roller of a fixing unit is provided. The fixing unit has the press roller and a heat roller, between which a sheet is passed. The sheet is pressed against the heat roller by the press roller. The press roller has a cylinder and an elastic layer provided on the outer peripheral surface of the cylinder. Opposite ends of the cylinder are elastically supported by the first elastic support mechanisms. A shaft extending through the cylinder rotatably supports the central portion of the cylinder via a pair of bearings. Opposite ends of the shaft are elastically supported by second elastic support mechanisms. Each of the bearings is preferably spaced away from adjacent one of the first elastic support mechanisms by a distance one third to one fifth a distance between the first elastic support mechanisms.

6 Claims, 7 Drawing Sheets

PRESS ROLLER SUPPORTED AT OPPOSITE ENDS AND AT AN INTERIOR PORTION

CROSS REFERENCE TO RELATED APPLICATION

This application claims priority benefits of Japanese patent Application No. 7-2877 (1995) under 35 USC §119, the disclosure of said Japanese patent Application being incorporated herein by reference.

BACKGROUND OF THE INVENTION

1. Field of the Invention

The present invention relates to a press roller support structure for supporting a press roller of a fixing unit.

2. Description of Related Arts

Recently, electrostatic copying machines capable of making a copy of a large-size document original such as of JIS A0 size have become available. "JIS A0 size", which is one of the sheet sizes (finished dimensions) specified by Japanese Industrial standards, is 841 mm×1189 mm.

Since it is difficult to handle a large-size copy sheet such as of A0 size one by one, a roll sheet is generally used which is formed of an elongated continuous sheet wound around a roll core and installed in a copying machine.

In general, an electrostatic copying machine forms a copy image of a document original on a copy sheet in the following manner. The document original is scanned under light irradiation, and a photoreceptor is exposed to light reflected on the document original, whereby an electrostatic latent image is formed on the photoreceptor. The electrostatic latent image is developed into a toner image, which is then thermally fixed on a copy sheet in a fixing unit. Thus, a copy image of the document original is formed on the copy sheet.

The fixing unit has a rubber press roller and a heat roller heated by a heater and is adapted to thermally fix the toner image on the copy sheet passing between these rollers. The press roller is normally biased against the heat roller with the opposite ends thereof elastically supported by side plates.

In a copying machine adapted to copy a large-size document original, a longer-size press roll should be employed and, therefore, a longitudinally central portion of the press roll is liable to sag down. Thus, an uneven pressure is applied longitudinally to the heat roller by the press roller, resulting in biased transportation of a copy sheet passing between the press roller and the heat roller. This may cause the copy sheet to jam.

This problem is not limited to the aforesaid copying machine for copying a large-size document original, but may occur in a copying machine adapted to copy a medium- or larger-size document original which employs a relatively long press roller.

SUMMARY OF THE INVENTION

It is, therefore, an object of the present invention to provide a press roller support structure which can prevent biased transportation of a copy sheet due to an uneven pressure applied to a heat roller by a press roller.

According to one aspect of the present invention, to achieve the aforesaid object, there is provided, in a fixing unit having a heat roller and a press roller brought in rotation contact with each other and adapted to pass a sheet therebetween, a press roller support structure for supporting the press roller comprising: a cylinder incorporated as part of the press roller and having an elastic layer provided on an outer peripheral surface thereof; a shaft extending through the cylinder; a bearing provided between an outer peripheral surface of the shaft and an inner surface of the cylinder for rotatably supporting a longitudinally central portion of the cylinder around the shaft; a first pair of elastic support means for rotatably and elastically supporting opposite ends of the cylinder; and a second pair of elastic support means for elastically supporting opposite ends of the shaft.

According to the above-described aspect, the cylinder is supported at the opposite ends thereof by the first pair of elastic support means, while supported at the longitudinally central portion thereof by the bearing, shaft and second pair of elastic support means. Thus, the cylinder is supported at the opposite ends thereof as well as at the longitudinally central portion thereof and, therefore, the press roller can apply an even pressure longitudinally to the heat roller. This prevents a sheet from being transported biasedly with respect to a transportation direction, thereby preventing the occurrence of jam due to the biased transportation.

According to one of the preferred modes of the press roller support structure, the bearing includes a pair of bearings, and each of the bearings is spaced away from adjacent one of the first pair of elastic support means by a distance one third to one fifth a distance between the first pair of elastic support means. Since the press roller is supported at four different points located along the press roller, the press roller can more evenly apply a pressure to the heat roller.

DETAILED DESCRIPTION OF THE PREFERRED EMBODIMENT

An embodiment of the present invention will hereinafter be described with reference to the attached drawings.

Figure 1:
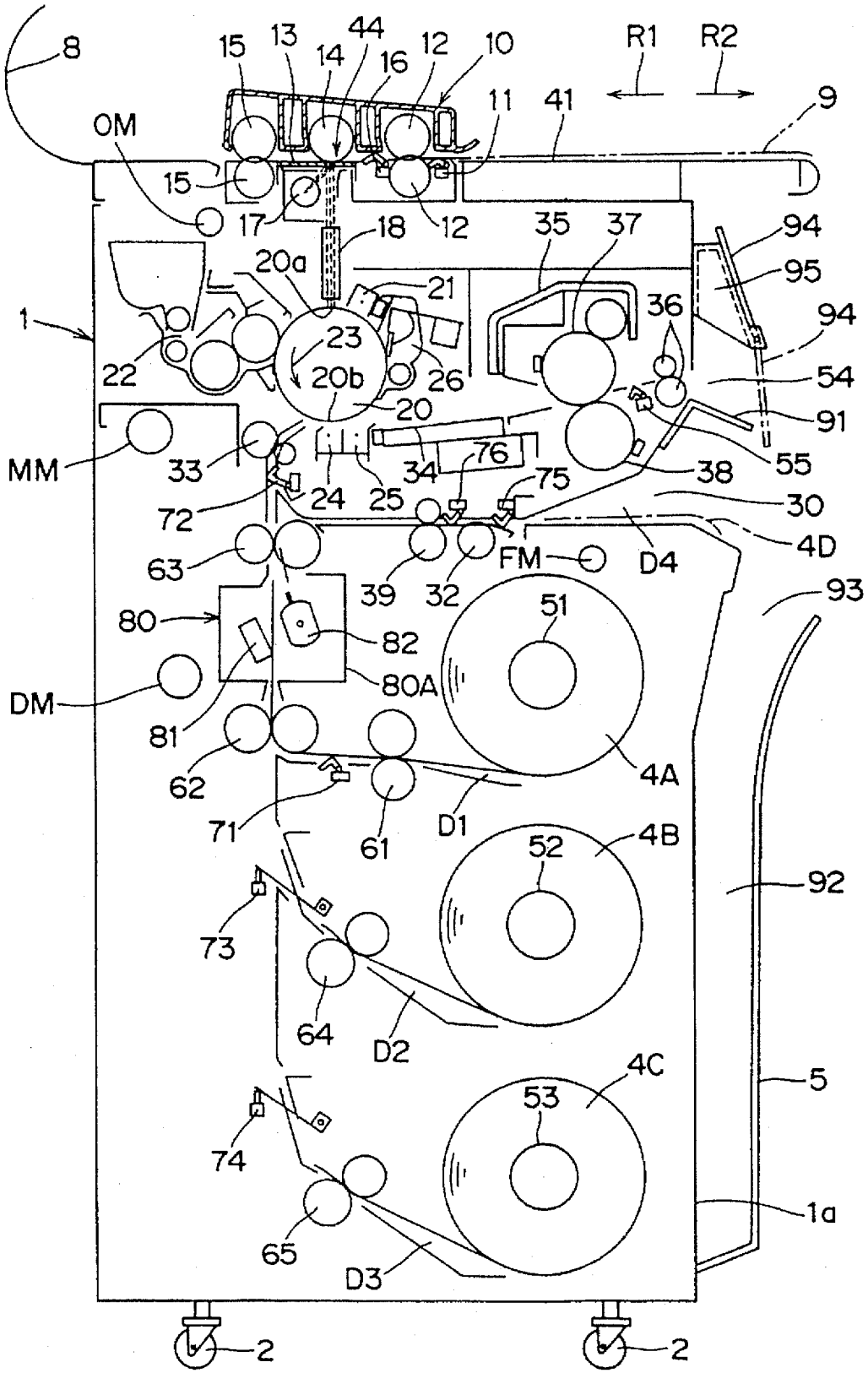
FIG. 1 is a schematic sectional view illustrating the internal construction of a copying machine to which a press roller support structure in accordance with one embodiment of the present invention is applied.
Figure 2:
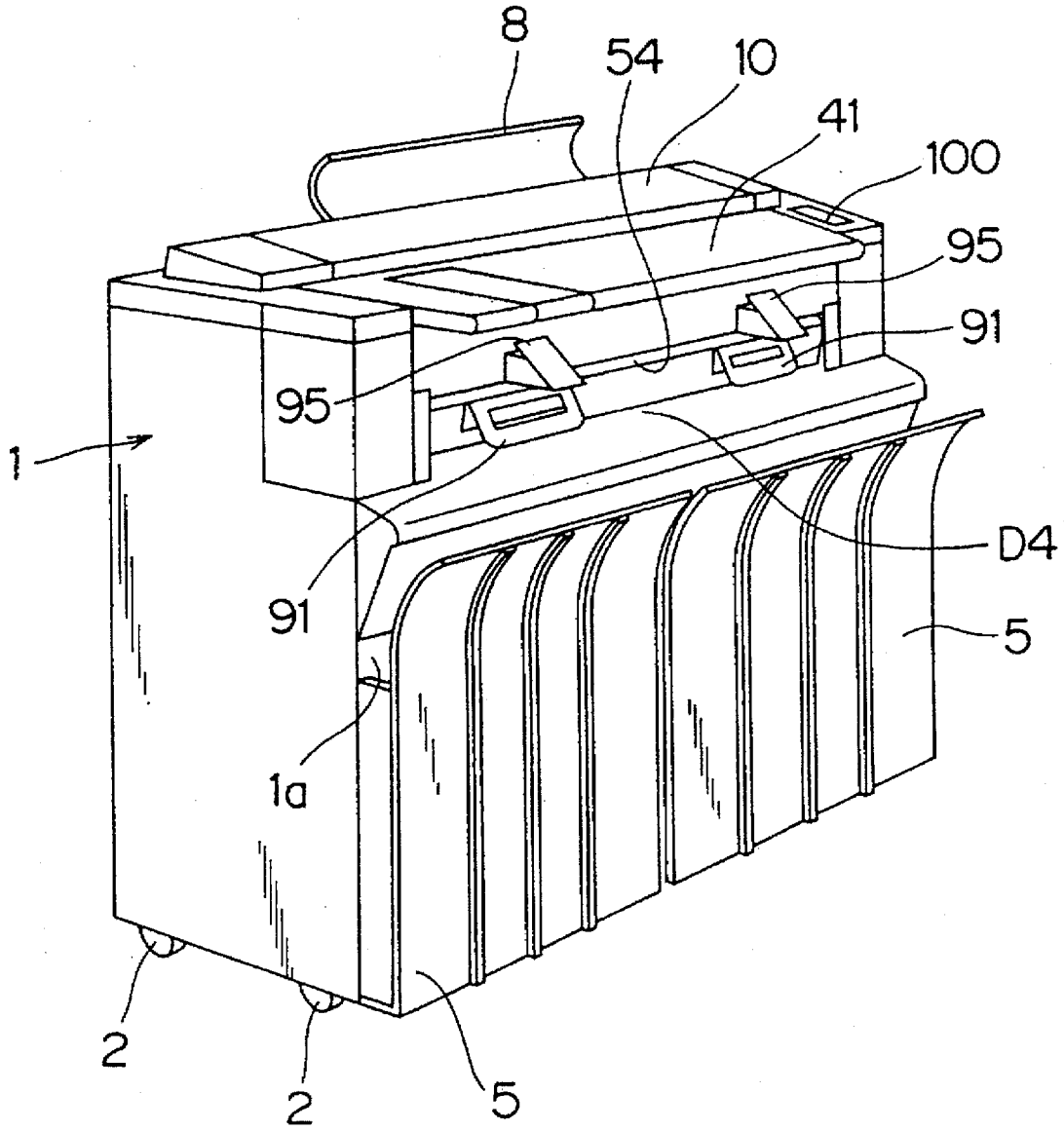
FIG. 2 is a perspective view illustrating the exterior construction of the copying machine.
Figure 3:
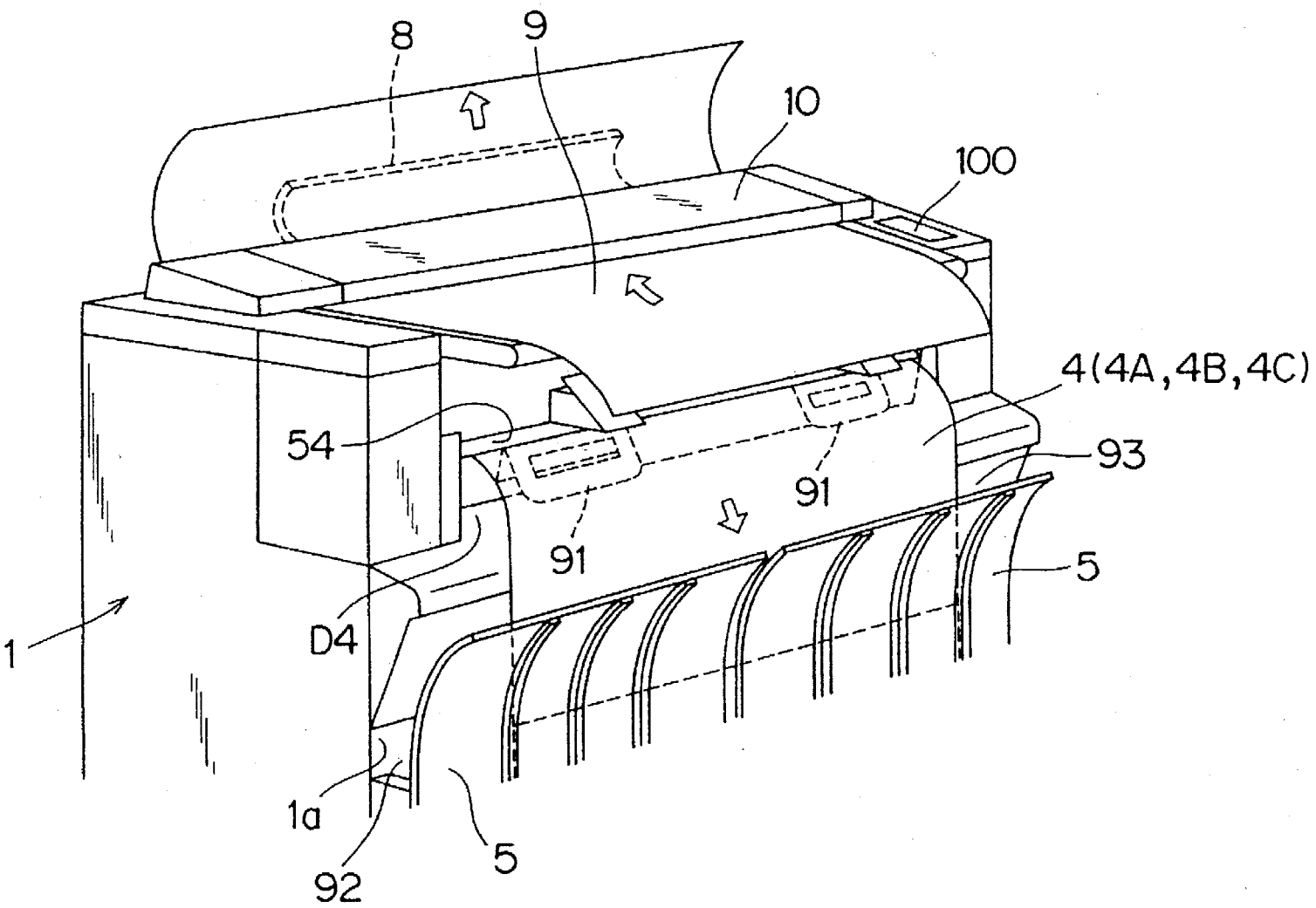
FIG. 3 is a perspective view illustrating the appearance of the copying machine in its operation.

FIG. 1 is a schematic sectional view illustrating the internal construction of a copying machine in accordance with one embodiment of the present invention. FIG. 2 is a perspective view illustrating the external construction of the copying machine, and FIG. 3 is a perspective view illustrating the appearance of the copying machine which is performing a copying operation. The copying machine is adapted to obtain an image of a large-size document original such as of A0 size. In the copying machine, the document original is scanned under light irradiation by a stationary optical system while being transported, and an image is formed on the basis of the optical scanning.

Referring to FIG. 1, a machine body i has caster wheels 2 on the under side thereof for free movement. Referring to FIGS. 1 to 3, a document-original transportation section 10is provided on the machine body 1 for transporting a document original 9 along a document-original transportation path 41 formed on the top face of the machine body 1. A discharge port 54 for discharging a sheet having a toner image transferred thereon opens in a front face 1*a* of the machine body 1. The sheet discharged from the discharge port 54 is guided by guide members 91, dropped through a guide opening 93 with the leading edge thereof oriented downward, and accommodated in a pocket 92 defined by a front cover 5 provided along the front face 1*a* of the machine body 1, as shown in FIG. 3. On an edge portion of the top face of the machine body 1 is provided with an operation section 100 having switches, keys and the like for making various settings related to a copying operation.

Referring to FIG. 1, three roll sheets 4A, 4B and 4C which are located vertically in upper, middle and lower positions and each wound into a roll shape are accommodated within a portion between the vertically middle portion and the lower portion of the machine body 1. The roll sheets 4A, 4B and 4C are rolled around feed reels 51, 52 and 53, respectively. Examples of sheets to be used as these roll sheets 4A, 4B and 4C include normal paper, film and tracing paper. In the central portion of the machine body 1 is disposed a bypass transportation path D4 for feeding a cut-sheet preliminarily cut into a predetermined length such as of A0 size to A4 size through a manually sheet feeding section 30 provided on the front face 1*a* of the machine body 1. The roll sheet 4A in the upper position is transported along a first transportation path D1 to a photoreceptor drum 20 through the feed reel 51, sheet feeding rollers 61, a first leading-edge detection switch 71 for detecting the leading edge of the transported roll sheet 4A, transportation rollers 62, a cutter mechanism 80, transportation rollers 63, a second leading-edge detection switch 72 for detecting the leading edge of the transported sheet 4A, 4B, 4C or 4D, and transportation rollers 33 in this order. The roll sheet 4B in the middle position is transported along a second transportation path D2 to the photoreceptor drum 20 through the feed reel 52, sheet feeding rollers 64, a third leading-edge detection switch 73 for detecting the leading edge of the transported roll sheet 4B, the transportation rollers 62, the cutter mechanism 80, the transportation rollers 63, the second leading-edge detection switch 72, and the transportation rollers 33 in this order. The transportation path downstream of the transportation rollers 62 is common to the first transportation path D1.

The roll sheet 4C in the lower position is transported along a third transportation path D3 to the photoreceptor drum through the feed reel 53, sheet feeding rollers 65, a fourth leading-edge detection switch 74 for detecting the leading edge of the transported roll sheet 4C, the transportation rollers 62, the cutter mechanism 80, the transportation rollers 63, the second leading-edge detection switch 72, and the transportation rollers 33 in this order. The path downstream of the transportation rollers 62 is common to the first transportation path D1.

The bypass transportation path D4 is a path which leads the cut-sheet 4D introduced from the manually sheet feeding section 30 to the photoreceptor drum 20 through a fifth leading-edge detection switch 75 for detecting the leading edge of the transported cut-sheet, a separation roller 32 for separating cut-sheets one from another by an abut plate (not shown) abutted against the cut-sheets, a sixth leading-edge detection switch 76 for detecting the leading edge of the transported cut-sheet, resist rollers 39, the second leading-edge detection switch 72 and the transportation rollers 33 in this order. The path downstream of the second leading-edge detection switch 72 in the bypass transportation path D4 is common to the first transportation path D1.

The cutter mechanism 80 has an elongated stationary blade 81 provided in a casing 80A and extending in a direction perpendicular to a transportation direction of the roll sheet 4A, 4B or 4C, and a rotary blade 82 cooperating with the stationary blade 81 to cut the transported roll sheet 4A, 4B or 4C therebetween. The roll sheet 4A, 4B or 4C is transported upward through the cutter mechanism 80.

The document-original transportation section 10 is adapted to switch the transportation direction to either a regular direction R1 or a reverse direction R2 for the transportation of the document original 9. The image forming operation is performed when the document original is transported in the regular direction R1. When a plurality of copies are made from one document original, the document-original transportation section 10 alternates the regular transportation direction R1 and the reverse transportation direction R2 to transport the document original. The document-original transportation path 41 is provided upstream the document-original transportation section 10 with respect to the regular direction R1 on the top face of the machine body 1 and laterally projects from the top face of the machine body 1.

The document-original transportation section 10 has a first document-original edge detection switch 11, first transportation rollers 12, a second document-original edge detection switch 16, a second transportation roller 14 and third transportation rollers 15 arranged along the regular transportation direction R1 in this order.

The first transportation rollers 12 are driven in response to the detection of the leading edge (on the downstream side in the regular transportation direction R1) of the document original 9 when the first document-original edge detection switch 11 is switched on. The second transportation roller 14 facing opposite to a transparent plate 13 for exposing the document original 9 to slit light serves to press the document original 9 against the transparent plate 13. The third transportation rollers 15 serve to discharge the document original 9 after the light exposure.

The second document-original edge detection switch 16 is switched on when the document original 9 is transported therethrough in the regular transportation direction R1, thereby detecting the leading edge (with respect to the regular direction R1) of the document original 9. In response to the switch on of the second document-original edge detection switch 16, the transportation of the roll sheet 4A, 4B or 4C (hereinafter referred to simply as "roll sheet 4", the term is used to explain the copying operation) is started, thereby coordinating the transportation of the roll sheet 4 with that of document original 9.

The first document-original edge detection switch 11 is switched off after the document original 9 is transported therethrough in the regular transportation direction R1, thereby detecting the tail edge (with respect to the regular direction R1) of the document original 9. The cutter mechanism 80 is driven at a preset time point a predetermined time period after the detection of the tail edge of the document original 9 to cut the roll sheet 4. In this embodiment, the length of the transportation path extending from the cutter mechanism 80 to an image transfer position 20*b* of a corona discharger for image transfer 24 is set longer than the length of the document-original transportation path extending from the first document-original edge detection switch 11 to a document-original light-exposure position 44 by a distance between the light exposure position 20*a* of the photoreceptor drum 20 and the image transfer position 20*b*, so that the tail edge of the sheet 4 cut at the preset time point can correspond to the tail edge of the document original 9 for image formation.

The second document-original edge detection switch 16 is switched off after the document original 9 is transported therethrough in the reverse transportation direction R2, thereby detecting the tail edge of the document original 9 transported in the reverse direction R2. In response to the switch off of the second document-original edge detection switch 16, the driving of the transportation rollers 12, 14 and 15 is stopped. At this time, the leading edge of the document original 9 is held between the transportation rollers 12 for the next copying operation. A reference numeral 8 denotes a reversion member for preventing the document original 9 from dropping to the rear side of the machine body 1 by reversing the transportation direction of the document original.

A stationary light source 17 for irradiating the document surface of the document original 9 is disposed in a predetermined relation with respect to the transparent plate 13. The light from the light source 17 is emitted onto the document surface through the transparent plate 13. The light reflected on the surface of the document original 9 is led to the surface of the photoreceptor drum 20 disposed in a generally central portion of the machine body 1 by means of a selfoc lens 18. Before being exposed to the light from the selfoc lens 18, the surface of the photoreceptor drum 20 is uniformly charged by a corona discharger 21 for electrostatic charging. After the light exposure, an electrostatic latent image corresponding to a document original image is formed on the surface of the photoreceptor drum 20. The electrostatic latent image is developed into a toner image by a developing unit 22. The toner image formed on the photoreceptor drum 20 is brought into the vicinity of the corona discharger 24 for image transfer, as the photoreceptor drum 20 is rotated in a direction indicated by the arrow 23.

On the other hand, the sheet 4 led to the photoreceptor drum 20 from the transportation path D1, D2 or D3 is led into the vicinity of the corona discharger for image transfer 24 with being brought into contact with the surface of the photoreceptor drum 20. Then, the toner image formed on the surface of the photoreceptor drum 20 is transferred onto the sheet 4 by way of corona discharge by the corona discharger for image transfer 24. The sheet 4 having the toner image transferred thereon is removed from the surface of the photoreceptor drum 20 by way of corona discharge by a corona discharger 25 for sheet removal, and then led to a fixing unit 35 through a transportation path 34. In the fixing unit 35, toner is fixed onto the surface of the sheet 4 by heat-pressing the sheet 4 between a heat roller 37 and a press roller 38. The sheet 4 on which the toner is fixed is discharged out of the machine body 1 through a discharge detection switch 55 and discharge rollers 36, guided by the guide members 91, and accommodated in the pocket 92, as described above. After the toner image is transferred, the toner remaining on the surface of the photoreceptor drum 20 is removed by a cleaning unit 26 for the next electrostatic latent image formation. Similarly, the cut-sheet 4D led to the photoreceptor drum 20 from the bypass sheet feeding path D4 is subjected to the toner image transfer and the toner fixation, and then discharged into the pocket 92.

Image forming means is constituted by such members as the photoreceptor drum 20, the developing unit 22 and the corona discharger for image transfer 24. In this embodiment, the copying machine further includes a main motor MM for driving the image forming means, a sheet feeding motor DM for driving the transportation rollers for feeding the sheet 4A, 4B, 4C and 4D, a fixation motor FM for driving the heat roller 37 and press roller 38 of the fixing unit 35, and a document-original feeding motor OM for driving the document original transportation section 10.

With reference to FIGS. 4 to 7, there will next be described a press roller support structure for supporting the press roller 38, which is a feature of the present invention.

Figure 4:
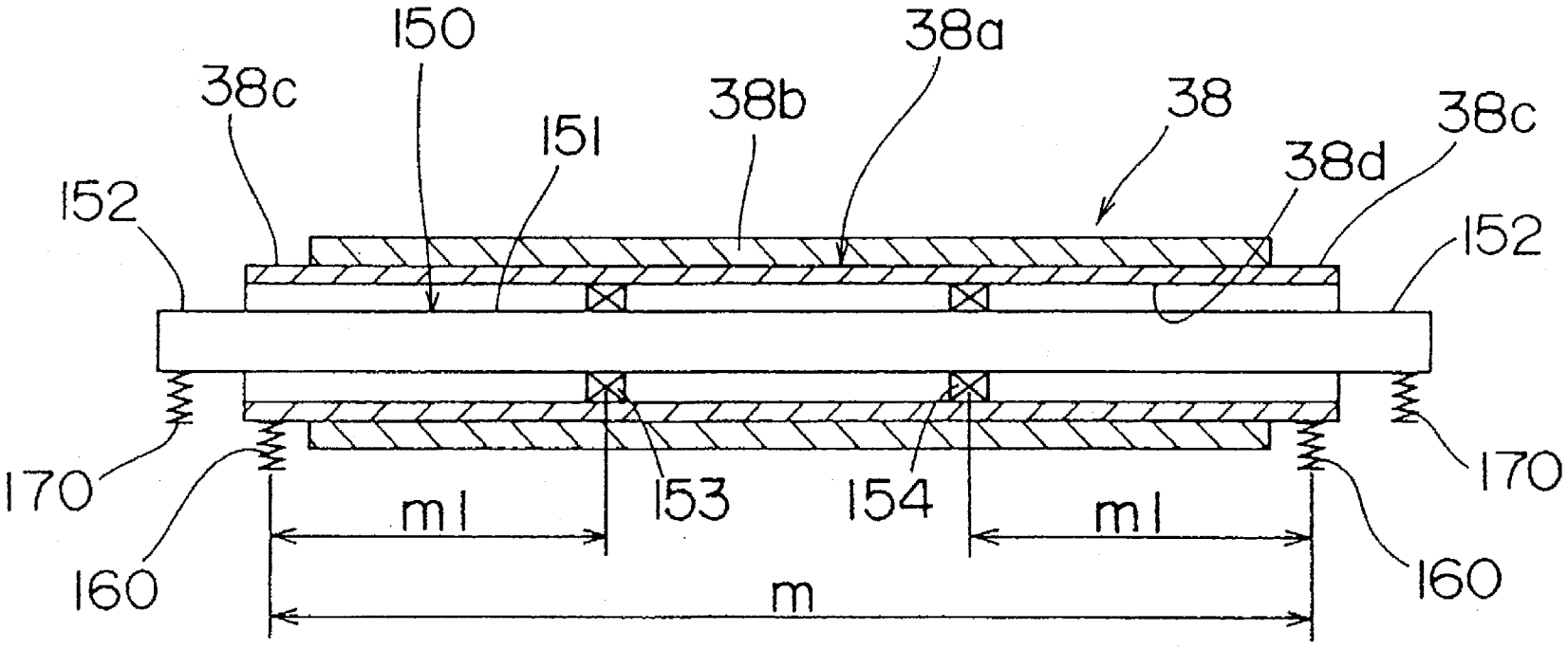
FIG. 4 is a schematic sectional view illustrating the press roller support structure.
Figure 5:
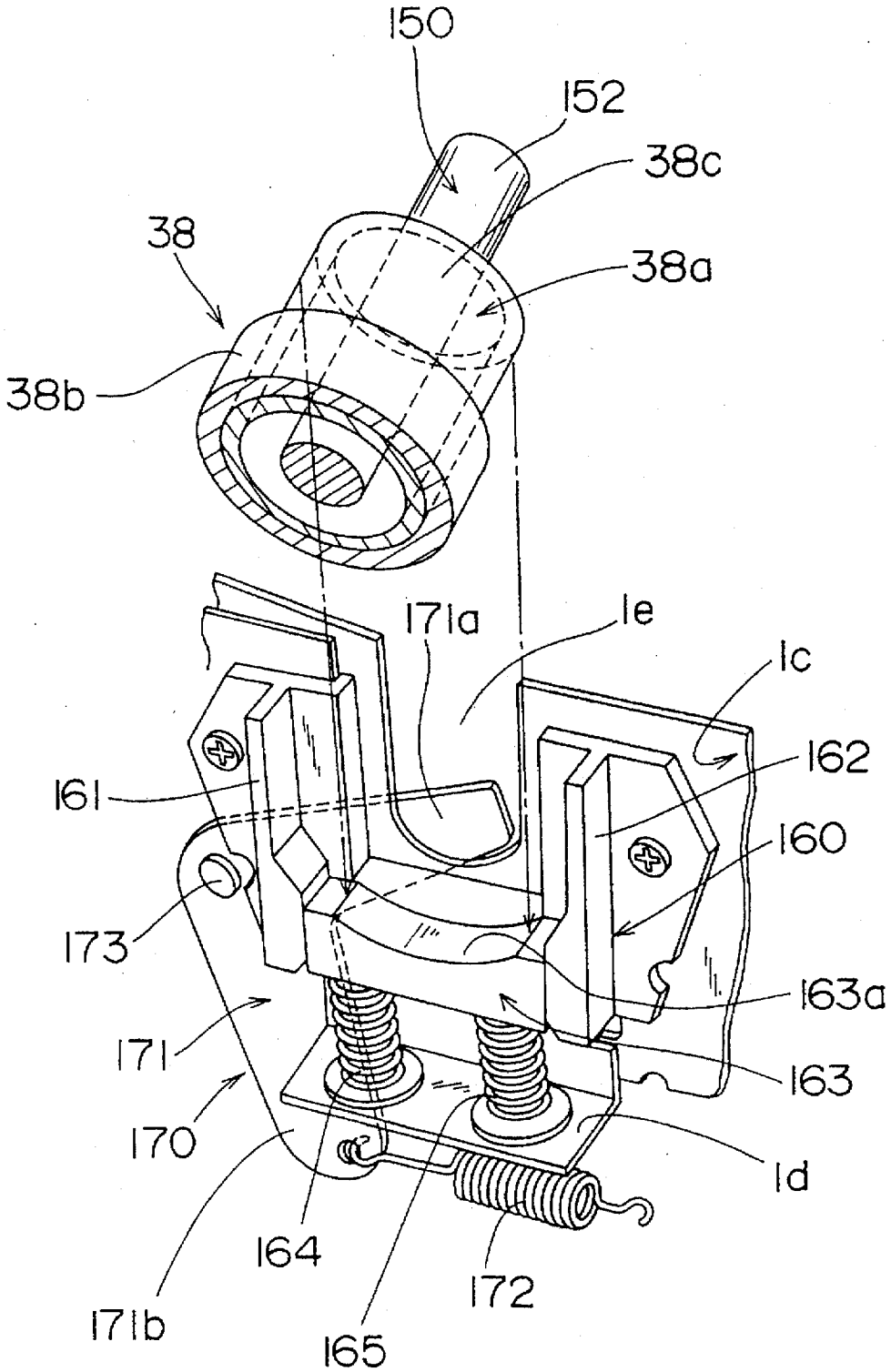
FIG. 5 is a partially exploded perspective view illustrating the press roller support structure.

Referring to FIG. 4, the press roller 38 includes a cylinder 38*a* and a rubber layer 38*b* provided on an outer peripheral surface of the cylinder 38*a*. The rubber layer 38*b* is not provided on opposite ends 38*c* of the cylinder 38*a*. A shaft 150 extends through the cylinder 38*a*, and a pair of bearings 153 and 154 for supporting the cylinder 38*a* rotatably around the shaft 150 are provided between an outer peripheral surface 151 of the shaft 150 and an interior surface 38*d* of the cylinder 38*a*. The opposite ends 152 of the shaft 150 and the opposite ends 38*c* of the cylinder 38*a* are elastically supported by first and second elastic support mechanisms 160 and 170, respectively, as shown in FIG. 5. In FIG. 4, the elastic support mechanisms are schematically shown.

Figure 6:
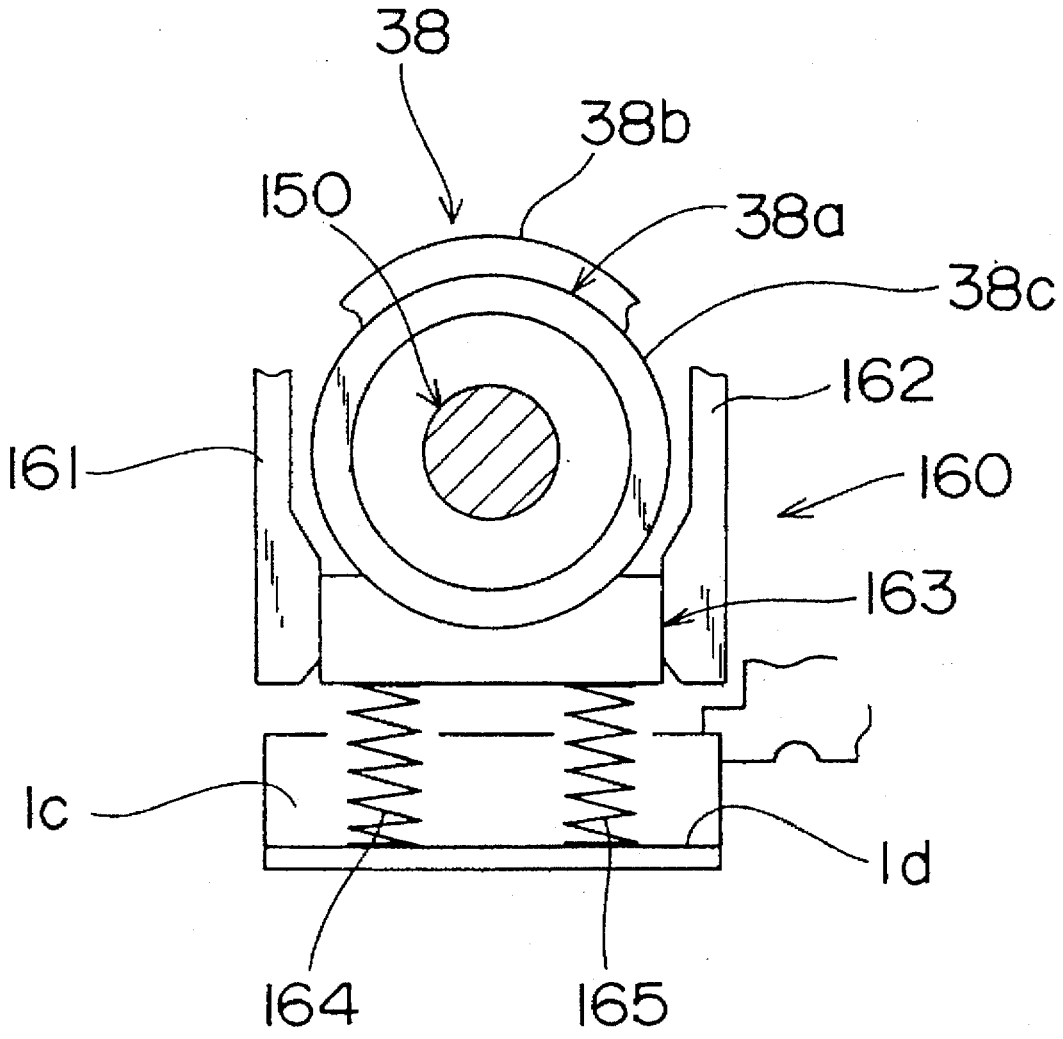
FIG. 6 is a schematic side view illustrating a first elastic support mechanism.

Referring to FIGS. 5 and 6, the first elastic support mechanisms 160 supporting the opposite ends 38*c* of the cylinder 38*a* each include: (1) a pair of guide members 161 and 162 fixed to a side plate 1*c* of the machine body 1; (2) a cylinder receiving member 163 for receiving the corresponding end 38*c* of the cylinder 38*a* to be guided by the guide members 161 and 162 for vertical movement; and (3) a pair of compression coil springs 164 and 165 provided between the cylinder receiving member 163 and a step 1*d* formed by bending part of the side plate 1*c* for elastically biasing the cylinder receiving member 163 upward.

An upper face of the cylinder receiving member 163 is formed into a concavely curved surface 163*a* having substantially the same radius of curvature as that of the outer peripheral surface of the cylinder 38*a* to receive the cylinder 38*a*.

Figure 7:
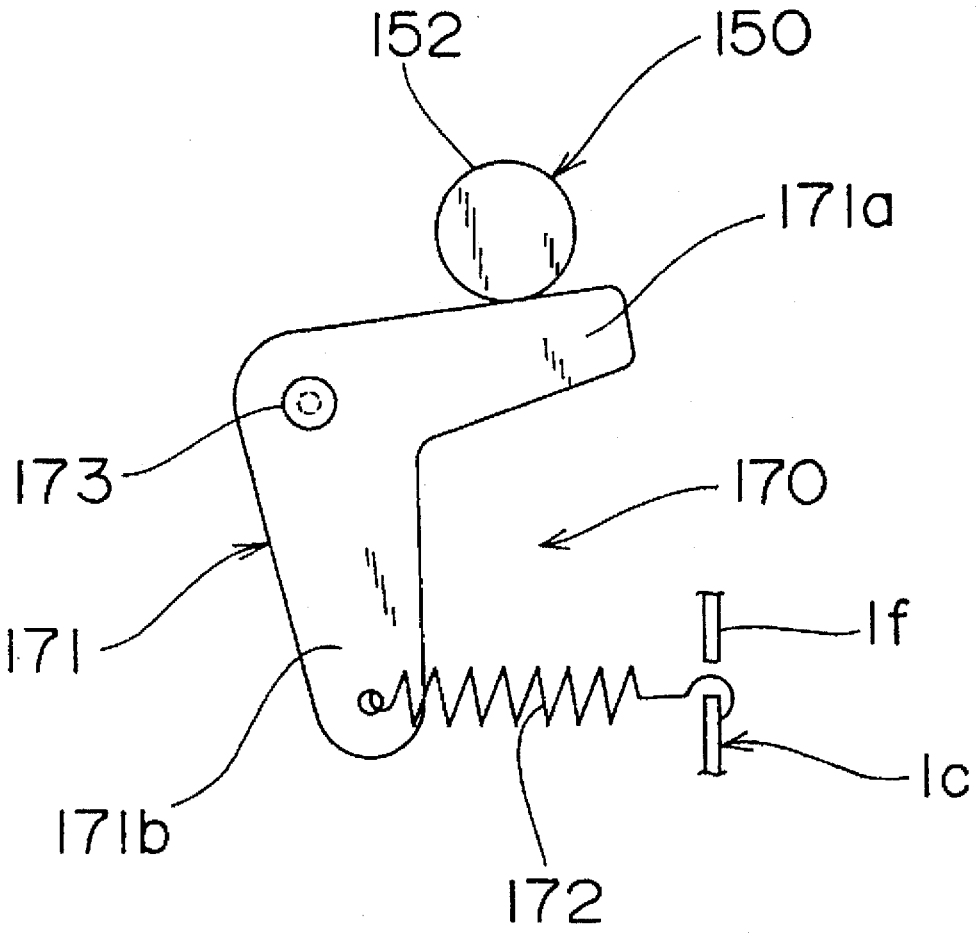
FIG. 7 is a schematic side view illustrating a second elastic support mechanism.

Referring to FIGS. 5 and 7, the second elastic support mechanisms 170 supporting the ends 152 of the shaft 150 each include: (1) a shaft receiving member 171 for receiving the corresponding end 152 of the shaft 150 introduced into a recess 1*e* formed in the side plate 1*c* to be rotatably supported by the side plate 1*c*; and (2) a tension coil spring 172 for elastically and rotatably biasing the shaft receiving member 171 to allow the shaft receiving member 171 to push up the end 152 of the shaft 150.

The shaft receiving member 171 is a V-shaped plate having a first portion 171*a* abutting against the shaft 150 and a second portion 171*b* to which one end of the tension coil spring 172 is hooked, and rotatably supported on the side plate 1*c* by a pin 173 extending through a junction of the first portion 171*a* and the second portion 171*b*.

As shown in FIG. 7, the other end of the tension coil spring 172 is hooked to a portion if formed by bending part of the side plate 1*c*.

In this embodiment, as shown in FIG. 4, the second elastic support mechanisms 170 supporting the opposite ends 152 of the shaft 150 support the cylinder 38*a* via the bearings 153 and 154 at two positions which generally equidistantly divide the length of the cylinder 38*a* into three (or at two positions located with the longitudinally central position of the cylinder 38*a* interposed therebetween). On the other hand, the first elastic support mechanisms 160 support the opposite ends of the cylinder 38*a*. Thus, the elongated press roller 38 can apply a generally even pressure longitudinally to the heat roller 37. Accordingly, the biased transportation of the roll sheet 4 can be assuredly prevented which would occur due to an uneven pressure applied to the heat roller, whereby the occurrence of jam due to the biased transportation can be assuredly prevented.

Referring to FIG. 4, a ratio me/m of a distance me between each first elastic support mechanism 160 and adjacent bearing 153 or 154 to a distance m between the first elastic support mechanisms 160 is preferably ⅓ to ⅕ to allow the press roller 38 to more evenly apply a pressure to the heat roller 37. Though this embodiment employs two bearings, only one bearing may be provided at the longitudinally central position of the cylinder 38, or three or more bearings may be provided along the cylinder 38*a*. It should be understood that various modifications may be made without departing from the spirit and scope of the present invention, as defined in the appended claims.

What is claimed is:

1. A press roller support structure for supporting the press roller of a fixing unit for fixing a toner image on a sheet, the press roller being rotatably in contact with a heat roller of the fixing unit and pressing the sheet to the heat roller, the structure comprising:

a cylinder incorporated as part of the press roller and having an elastic layer provided on an outer peripheral surface thereof;

a shaft extending through the cylinder;

a bearing provided between an outer peripheral surface of the shaft and an inner surface of the cylinder for rotatably supporting a longitudinally central portion of the cylinder around the shaft;

a first pair of elastic support means for rotatably and elastically supporting opposite ends of the cylinder; and a second pair of elastic support means for elastically supporting opposite ends of the shaft.

2. A press roller support structure as set forth in claim 1, wherein the bearing includes a pair of bearings, each of the bearings being spaced away from an adjacent one of the first pair of elastic support means by a distance one third to one fifth a distance between each of the first pair of elastic support means.

3. A press roller support structure as set forth in claim 1, wherein the first pair of elastic support means each include a cylinder receiving member for receiving an end of the cylinder, and a biasing member for elastically biasing the cylinder receiving member upward.

4. A press roller support structure as set forth in claim 3, wherein the cylinder receiving member includes a receiving surface, having substantially the same radius of curvature as that of the outer peripheral surface of the cylinder, for receiving the cylinder.

5. A press roller support structure as set forth in claim 1, wherein the second pair of elastic support means each include a shaft receiving member rotatably supported by a side plate for receiving an end of the shaft, and a biasing member for biasing the shaft receiving member in one rotational direction to allow the shaft receiving member to lift up the shaft.

6. A press roller support structure as set forth in claim 5, wherein the shaft receiving member has a first portion at an angle with a second portion, the first portion supporting the shaft, the second portion being biased by the biasing member.

* * * * *